US011670442B2

(12) United States Patent
Horie

(10) Patent No.: US 11,670,442 B2
(45) Date of Patent: Jun. 6, 2023

(54) COIL COMPONENT AND ELECTRONIC DEVICE

(71) Applicant: TAIYO YUDEN CO., LTD., Tokyo (JP)

(72) Inventor: Katsuyuki Horie, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 795 days.

(21) Appl. No.: 16/572,288

(22) Filed: Sep. 16, 2019

(65) Prior Publication Data

US 2020/0105451 A1 Apr. 2, 2020

(30) Foreign Application Priority Data

Sep. 28, 2018 (JP) ..... JP2018-185572

(51) Int. Cl.

| | |
|---|---|
| ***H01F 17/00*** | (2006.01) |
| ***H01F 27/29*** | (2006.01) |
| ***H01F 27/28*** | (2006.01) |
| ***H01F 27/24*** | (2006.01) |
| ***H01F 17/04*** | (2006.01) |

(Continued)

(52) U.S. Cl.

CPC ..... *H01F 17/045* (2013.01); *H01F 3/10* (2013.01); *H01F 27/263* (2013.01); *H01F 27/266* (2013.01); *H01F 27/2823* (2013.01); *H01F 27/292* (2013.01); *H01F 41/0246* (2013.01); *H01F 2017/0093* (2013.01)

(58) Field of Classification Search

CPC .. H01F 17/045; H01F 27/292; H01F 27/2828; H01F 27/24

See application file for complete search history.

(56) References Cited

U.S. PATENT DOCUMENTS 6,242,996 B1 6/2001 Sato et al.
6,373,366 B1 * 4/2002 Sato ..... H01F 27/292 336/200

(Continued)

FOREIGN PATENT DOCUMENTS

JP H04105520 U 9/1992
JP H04105520 U * 9/1992

(Continued)

OTHER PUBLICATIONS

Notice of Allowance issued by U.S. Patent and Trademark Office, dated Jan. 13, 2023, for a co-pending U.S. Appl. No. 17/093,169. (9 pages) (Year: 2023).*

(Continued)

*Primary Examiner* — Mohamad A Musleh
*Assistant Examiner* — Malcolm Barnes
(74) *Attorney, Agent, or Firm* — Law Office of Katsuhiro Arai

(57) ABSTRACT

A coil component includes: a first substrate body and a second substrate body, both formed in a manner containing a magnetic material; an adhesive containing an organic material and a filler, for bonding the first substrate body and the second substrate body; a coil formed by a conductor having an insulating film; and electrodes connected electrically to the coil; wherein the surface roughness of the face of the first substrate body bonded to the second substrate body via the adhesive is higher than the average grain size of the filler.

9 Claims, 11 Drawing Sheets

(51) Int. Cl.

| | |
|---|---|
| ***H01F 27/26*** | (2006.01) |
| ***H01F 3/10*** | (2006.01) |
| ***H01F 41/02*** | (2006.01) |

(56) References Cited

U.S. PATENT DOCUMENTS

| | | | | |
|---|---|---|---|---|
| 7,567,163 | B2 | 7/2009 | Dadafshar et al. | |
| 9,905,355 | B2 * | 2/2018 | Takagi | H01F 27/266 |
| 2003/0071704 | A1 * | 4/2003 | Toi | H01F 27/36 336/83 |
| 2007/0159289 | A1 * | 7/2007 | Lee | H01F 27/24 336/212 |
| 2008/0224813 | A1 * | 9/2008 | Hirai | H01F 17/045 336/216 |
| 2011/0121935 | A1 * | 5/2011 | Chu | H01F 41/0246 29/606 |
| 2012/0133469 | A1 * | 5/2012 | Tomonari | H01F 27/292 336/192 |
| 2015/0035635 | A1 | 2/2015 | Hayashi et al. | |
| 2015/0084731 | A1 * | 3/2015 | Takagi | H01F 19/08 336/212 |
| 2016/0035482 | A1 | 2/2016 | Aoki et al. | |
| 2016/0365191 | A1 | 12/2016 | Horie et al. | |
| 2017/0025212 | A1 | 1/2017 | Jerez et al. | |
| 2017/0229227 | A1 * | 8/2017 | Igarashi | H01F 27/2823 |
| 2018/0286554 | A1 | 10/2018 | Kojima | |
| 2019/0244744 | A1 * | 8/2019 | Takenaka | H01F 27/29 |
| 2019/0287710 | A1 * | 9/2019 | Igarashi | C09J 163/00 |

FOREIGN PATENT DOCUMENTS

| | | | | |
|---|---|---|---|---|
| JP | 2007142931 | A | | 6/2007 |
| JP | 2009224649 | A | | 10/2009 |
| JP | 2009259991 | A | | 11/2009 |
| JP | 2012119568 | A | | 6/2012 |
| JP | 2014099586 | A | | 5/2014 |
| JP | 2014099587 | A | * | 5/2014 |
| JP | 2014099587 | A | | 5/2014 |
| JP | 2015032643 | A | | 2/2015 |
| JP | 2015065272 | A | | 4/2015 |
| JP | 2016035972 | A | | 3/2016 |
| JP | 2017005079 | A | | 1/2017 |
| JP | 2017508298 | A | | 3/2017 |
| JP | 2017143118 | A | | 8/2017 |
| JP | 2018174219 | A | | 11/2018 |
| WO | 2007060961 | A1 | | 5/2007 |
| WO | 2015135703 | A1 | | 9/2015 |

OTHER PUBLICATIONS

A Notification of Reasons for Refusal issued by the Japanese Patent Office, dated Feb. 5, 2019, for Japanese counterpart application No. 2017071219, of co-pending U.S. Appl. No. 15/925,583. (12 pages).

A Notification of Reasons for Refusal issued by the Japanese Patent Office, dated Oct. 2, 2018, for Japanese counterpart application No. 2017071219, of co-pending U.S. Appl. No. 15/925,583. (13 pages).

Non-Final Office Action issued by U.S. Patent and Trademark Office, dated May 5, 2020, for a co-pending U.S. Appl. No. 15/925,583. (25 pages).

A Notification of Reasons for Refusal issued by the Japanese Patent Office, dated Nov. 26, 2019, for Japanese counterpart application No. 2018-185572. (5 pages).

Non-Final Office Action issued by U.S. Patent and Trademark Office, dated Sep. 15, 2022, for a co-pending U.S. Appl. No. 17/093,169 (18 pages).

Notice of Allowance issued by U.S. Patent and Trademark Office, dated Jan. 13, 2023, for a co-pending U.S. Appl. No. 17/093,169. (9 pages).

* cited by examiner

COIL COMPONENT AND ELECTRONIC DEVICE

CROSS-REFERENCE TO RELATED APPLICATIONS

The present application claims priority to Japanese Patent Application No. 2018-185572, filed Sep. 28, 2018, the disclosure of which is incorporated herein by reference in its entirety including any and all particular combinations of the features disclosed therein.

BACKGROUND

Field of the Invention

The present invention relates to a coil component and an electronic device.

Description of the Related Art

In recent years, coil components that are to be mounted on circuit boards of mobile devices and other electronic devices are required to have high impact resistance to withstand the impacts from dropping, etc. Wound common mode choke coils, which are formed with a drum core and a planar core in the coil, are examples of known coil components. To achieve high impact resistance, one requirement is to strengthen the bonding between the drum core and the planar core. For example, bonding a flange part constituting a drum core with a planar core, by forming grooves in the bonding surface of the flange part and then filling an adhesive in these grooves to securely bond the flange part with the planar core, is known (refer to Patent Literature 1, for example). Also known is providing gaps in the bonding surface of the flange part and then placing an adhesive in these gaps to achieve high bonding strength with a small amount of adhesive (refer to Patent Literature 2, for example).

Background Art Literatures

[Patent Literature 1] Japanese Patent Laid-open No. 2009-224649

[Patent Literature 2] Japanese Patent Laid-open No. 2014-99587

SUMMARY

The present invention is a coil component comprising: a first substrate body and a second substrate body, both formed in a manner containing a magnetic material; an adhesive containing an organic material and a filler, for bonding the first substrate body and the second substrate body; a coil formed by a conductor having an insulating film; and electrodes connected electrically to the coil; wherein the surface roughness of the face of the first substrate body to be bonded to the second substrate body via the adhesive is higher than the average grain size of the filler.

The present invention is an electronic device comprising: the aforementioned coil component; and a circuit board on which the coil component has been mounted.

BRIEF DESCRIPTION OF THE DRAWINGS

FIG. 2A is a cross-sectional view of the coil component pertaining to Example 1, while

FIG. 3A is a drawing for explaining the external dimensions of the coil component pertaining to Example 1, while

FIG. 6A is a cross-sectional view of the coil component pertaining to a comparative example, while

FIG. 8A is a cross-sectional view of the coil component pertaining to Example 2, while

FIG. 9A is a drawing for explaining the external dimensions of the coil component pertaining to Example 3, while

FIG. 10A is a perspective view showing an E-core and an I-core, while

DESCRIPTION OF THE SYMBOLS

Figure 1:
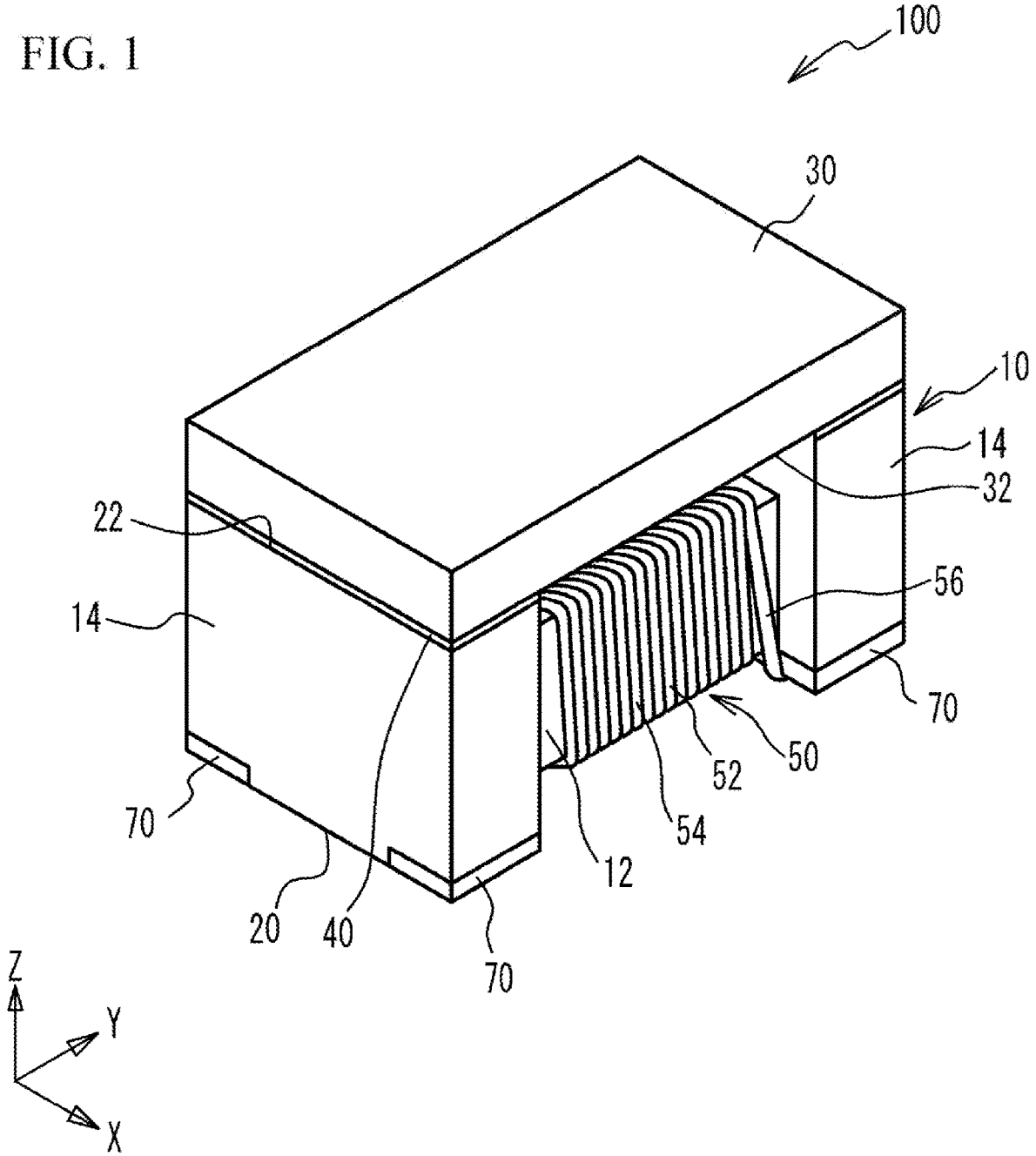
FIG. 1 is a perspective view of the coil component pertaining to Example 1.

10 Drum core
12 Shaft part
14 Flange part
20 Bottom face
22 Top face
30, 30*a*, 30*b* Planar core
32 Bottom face
40 Adhesive
42 Resin
44 Filler
46 Proximate part
50 Coil
52 Conductive wire
54 Wound part
56 Lead part
70 Electrode
80 E-core
82 I-core
84 Circuit board
86 Electrode
88 Solder
100 Coil component
500 Electronic device

DETAILED DESCRIPTION OF EMBODIMENTS

Examples of the present invention are explained below by referring to the drawings.

Example 1

Examples of the present invention are explained below by referring to the drawings. The coil component comprises: a first substrate body and a second substrate body, both formed in a manner containing a magnetic material; an adhesive containing an organic material and a filler; a coil including lead parts, formed by a conductor having an insulating film; and electrodes connected electrically to the coil.

FIG. 1 is a perspective view of the coil component pertaining to Example 1. In Example 1, a common mode choke coil is explained as an example of coil component. It should be noted that, in FIG. 1, the circumferential direction of the conductive wire 52 forming the coil 50, which is the direction parallel with the bottom face 20 of the flange part 14 which will be mounted on a circuit board, and also with the top face 22 on the opposite side of the bottom face 20, represents the X-axis direction, the direction of the coil axis of the coil 50 represents the Y-axis direction, and the direction orthogonal to the X-axis and Y-axis represents the Z-axis direction. As shown in FIG. 1, the coil component 100 in Example 1 comprises a drum core 10, a planar core 30, a coil 50, and multiple electrodes 70.

The drum core 10 includes a shaft part 12, and a pair of flange parts 14 provided on both ends of the shaft part 12 in the axial direction. The shaft part 12 is shaped as a circular cylinder or rectangular cylinder, for example. The flange part 14 is shaped as a rectangular solid, for example. The shaft part 12 is connected to the center part of the face of the flange part 14 to which the shaft part 12 is connected, for example. The flange part 14 has a bottom face 20 on the side which will be mounted on a circuit board, and a top face 22 on the opposite side of the bottom face 20.

The drum core 10 is formed in a manner containing a magnetic body material. For example, the drum core 10 is formed in a manner containing Ni—Zn, Mn—Zn, or other ferrite material, Fe—Si—Cr, Fe—Si—Al, Fe—Si—Cr—Al, or other soft magnetic alloy material, Fe, Ni, or other magnetic metal material, amorphous magnetic metal material, or nanocrystal magnetic metal material. If it is to be formed with a ferrite material, the drum core 10 may be formed by sintering the ferrite material. In this case, the drum core 10 is densified through the sintering process. If it is to be formed with metal magnetic grains, the drum core 10 may be formed by solidifying the metal magnetic grains with a resin, or by causing the insulating films formed on the surfaces of the metal magnetic grains to bond together. In this case, the shapes of the magnetic grains are roughly maintained in the drum core 10, because the magnetic grains are bonded by the resin or insulating films.

The planar core 30 has two flat faces, for example, so that it can couple the pair of flange parts 14 across the shaft part 12, and these flat faces have a rectangular shape. The planar core 30 is shaped as a rectangular solid, for example. The planar core 30 has a bottom face 32 bonded to the top face 22 of the flange part 14 with an adhesive 40. The planar core 30 is formed in a manner containing a magnetic body material. If it is to be formed with a ferrite material, for example, the planar core 30 may be formed by sintering the ferrite material, just like the drum core 10. If it is to be formed with metal magnetic grains, the planar core 30 may be formed by solidifying the metal magnetic grains with a resin, or by causing the insulating films formed on the surfaces of the metal magnetic grains to bond together.

The drum core 10 and planar core 30 may be formed with the same magnetic material, or they may be formed with different magnetic materials. It should be noted that the drum core 10 corresponds to the first substrate body whose face bonded to the other substrate body (i.e., the second substrate body) is required to have a surface roughness higher than an average particle size of the filler particles, while the planar core 30 corresponds to the second substrate body.

Figure 2A:
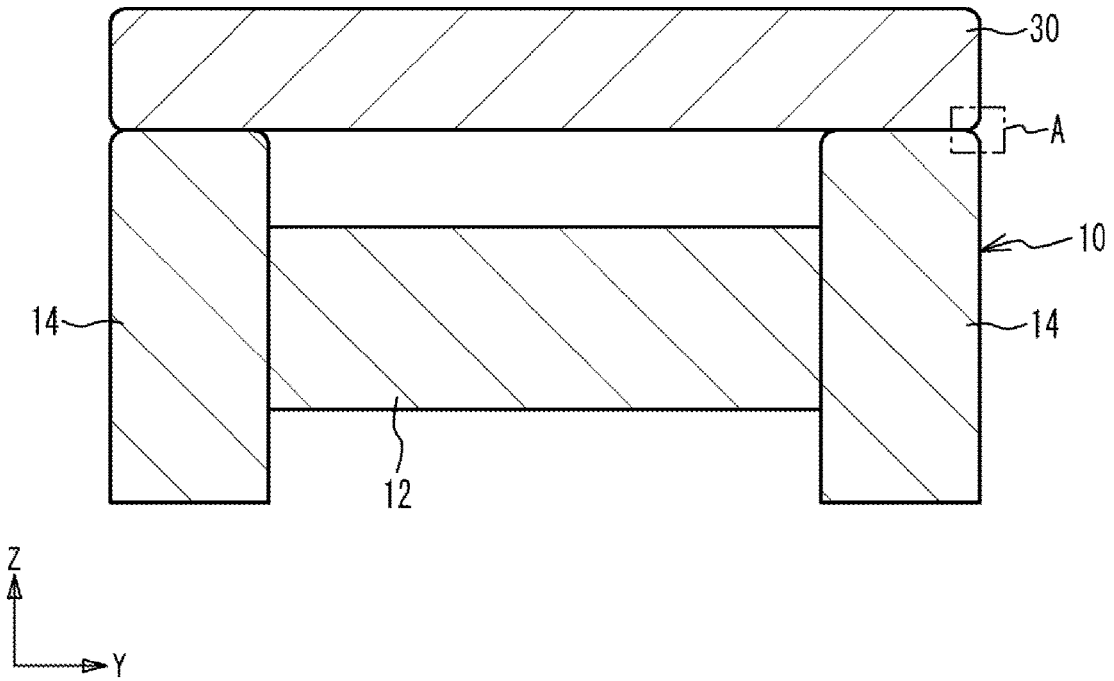
Figure 2B:
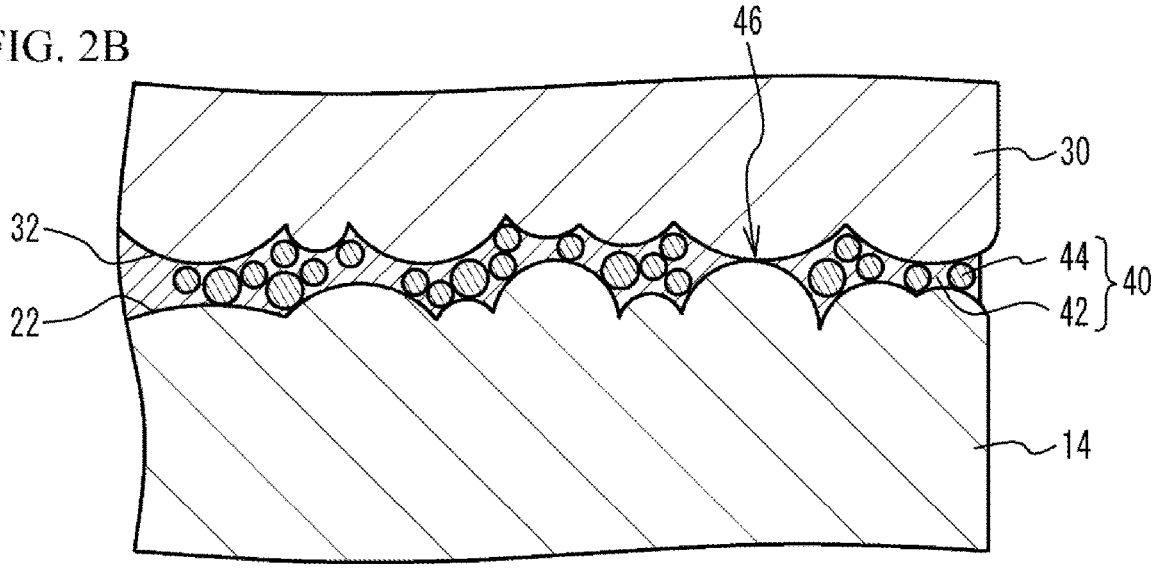
FIG. 2B is an enlarged view of Region A in FIG. 2A.

Now, the bonded portions of the flange part 14 of the drum core 10 and the planar core 30 are explained. FIG. 2A is a cross-sectional view of the coil component pertaining to Example 1, while FIG. 2B is an enlarged view of Region A in FIG. 2A. It should be noted that, in FIG. 2A, the coil 50 is not shown for the purpose of illustrative clarity. As shown in FIGS. 2A and 2B, the adhesive 40 is provided between the top face 22 of the flange part 14 and the bottom face 32 of the planar core 30. The adhesive 40 has cured, thus providing a fixed part where the flange part 14 and planar core 30 are fixed together. The adhesive 40 that bonds the top face 22 of the flange part 14 and the bottom face 32 of the planar core 30 is formed in a manner containing a resin 42 and a filler 44. Because of the filler 44 contained in the adhesive 40, mechanical strength can be improved. The resin 42 is a thermosetting resin and, for example, epoxy resin, silicone resin, or phenolic resin may be used. For example, it is a resin whose glass transition temperature Tg is 125° C. or higher. For the filler 44, silica grains, zirconia grains or other inorganic grains may be used. Preferably the filler 44 has good thermal conductivity and small linear expansion coefficient. Preferably the filler 44 has a spherical shape. This makes it easy to align the sizes of filler 44 grains and also allows the viscosity to be kept low when the filler 44 is kneaded with the resin 42, and consequently the percentage of the filler 44 in the adhesive 40 can be increased.

The percentage accounted for by the filler 44 in the adhesive 40 is 20 percent by weight or higher but no higher than 70 percent by weight in cured state. The percentage of the filler 44 is preferably 20 percent by weight or higher but lower than 50 percent by weight, because this makes it easy to reduce the thickness of the adhesive 40 or increase the bonding strength. Adjusting it to 50 percent by weight or higher but no higher than 70 percent by weight allows the linear expansion coefficient to be lowered. Additionally, adjusting it to 30 percent by weight or higher but no higher than 60 percent by weight achieves both of these properties, which makes it easy to accommodate a wide range of applications. The filler 44 has an average grain size of 2 μm or smaller, for example, but it may be 1 μm or smaller, or 0.5 μm or smaller. Also, in terms of size, the filler 44 has an average grain size is 0.1 μm or larger. By keeping the average grain size of the filler 44 in this range, dispersion of the filler 44 in the adhesive 40 can be ensured, and change in viscosity due to agglutination can also be prevented. In one example, where the filler 44 comprises silica grains, its average grain size is approx. 0.5 μm.

The surface roughness of the top face 22 of the flange part 14, which is at least one of its side faces, is higher than the average grain size of the filler 44. Also, the surface roughness of the bottom face 32 of the planar core 30, which is at least one of its flat faces, is higher than the average grain size of the filler 44. For example, the surface roughness Rz of the top face 22 of the flange part 14 and bottom face 32 of the planar core 30 is higher than the average grain size of the filler 44. As an example, the surface roughness of the top face 22 of the flange part 14 and bottom face 32 of the planar core 30 can be increased by, for example, barreling or otherwise machining the drum core 10 and planar core 30 using a large medium.

The surface roughness Rz of the top face 22 of the flange part 14 and bottom face 32 of the planar core 30 may be 10 μm or higher, for example, but it may be 20 μm or higher. The surface roughness Rz of the top face 22 of the flange part 14, and the surface roughness Rz of the bottom face 32 of the planar core 30, are 50 μm or lower, for example. Keeping the surface roughness Rz to 50 μm or lower makes it easy for the adhesive 40 to wet and spread over the surfaces of the flange part 14 and planar core 30. As a result, the thickness of the adhesive 40 can be made uniform, and additionally the thickness can be reduced. For example, the thickness of the adhesive 40 can be kept to 30 μm or less where it is thickly applied. Also, from the viewpoint of ensuring mechanical strength of the drum core 10 and planar core 30, the surface roughness Rz may be kept to 30 μm or lower. In one example where the drum core 10 and planar core 30 are formed by a Ni—Zn ferrite material, the surface roughness Rz of the top face 22 of the flange part 14 is approx. 15 μm, while the surface roughness Rz of the bottom face 32 of the planar core 30 is approx. 10 μm.

Also, the surface waviness of the bottom face 32 of the planar core 30 is smaller than the surface waviness of the top face 22 of the flange part 14. For example, the surface waviness Wa of the bottom face 32 of the planar core 30 is smaller than the surface waviness Wa of the top face 22 of the flange part 14. For example, the surface waviness Wa of the bottom face 32 of the planar core 30 is 30 μm to 50 μm, while the surface waviness Wa of the top face 22 of the flange part 14 is 40 μm to 80 μm.

Surface roughness Rz and surface waviness Wa can be measured over a standard length appropriate for the magnitude of surface roughness. It should be noted that, if the measurable range is limited, surface roughness Rz and surface waviness Wa may be measured over a length feasible within this range; for example, surface roughness Rz and surface waviness Wa may be measured over a length of approx. 1 mm to 2 mm. Surface roughness Rz and surface waviness Ra are defined in JIS B 0601. It should be noted that surface roughness Rz of each of the bonded faces of the first and second substrate bodies is substantially unchanged before and after bonding them using the adhesive.

Since the surface roughness of the top face 22 of the flange part 14 is higher than the average grain size of the filler 44, the filler 44 can enter the concaved parts of the top face 22 of the flange parts 14. Because of this, portions where the filler 44 is not present can be created where the distance between the top face 22 of the flange part 14 and the bottom face 32 of the planar core 30 is short, resulting in the formation of proximate parts 46 where the top face 22 of the flange part 14 and the bottom face 32 of the planar core 30 are making contact or facing each other over a very thin resin 42 in between. Presence of proximate parts 46 can be confirmed by polishing a cross-section and observing it with an optical microscope, and the spacing between the flange part 14 and the planar core 30 (thickness of the adhesive 40) can also be measured using a length measuring function. Additionally, proximate parts 46 can be identified using a three-dimensional X-ray inspection system.

As described above, the bonded portions where the flange part 14 and the planar core 30 are bonded together via the adhesive 40, include portions encompassing the resin 42 and filler 44 that are bonding the flange part 14 and the planar core 30, as well as proximate parts 46 where the flange part 14 and the planar core 30 are making direct contact or facing each other over a very thin resin 42 in between. Proximate parts 46 can be confirmed based on presence or absence of the resin component of the adhesive 40. For example, if cross-section observation reveals that the resin component is present over a thickness of 5 μm or less in the direction connecting the flange part 14 and the planar core 30, there is a thin resin 42; if this thickness is 0.5 μm or less, the two are making direct contact.

As shown in FIG. 1, the coil 50 is formed by a conductive wire 52 having an insulating film, and provided in a space formed by the drum core 10 and the planar core 30. The conductive wire 52 is wound around the shaft part 12 of the drum core 10 to form a wound part 54, while its end parts are led out from the wound part 54 to form lead parts 56. Since the coil component 100 in Example 1 is a common mode choke coil, two conductive wires 52 are wound around the outer periphery of the shaft part 12 in the same winding direction by the same number of turns, to form two coils 50. The conductive wires 52 are provided away from the bonded surfaces of the drum core 10 and planar core 30. For the method by which to wind the conductive wires 52, bifilar winding, layer winding or other commonly employed winding method may be used.

The metal wire portion of the conductive wire 52, which is covered with the insulating film, is formed by copper, silver, alloy containing copper, or the like, for example. The insulating film is formed by polyester imide or polyamide, for example.

The multiple electrodes 70 are provided on the bottom faces 20 of the flange parts 14. Two electrodes 70 are provided on one flange part 14. The electrodes 70 are electrically connected to the lead parts 56.

Figure 3A:
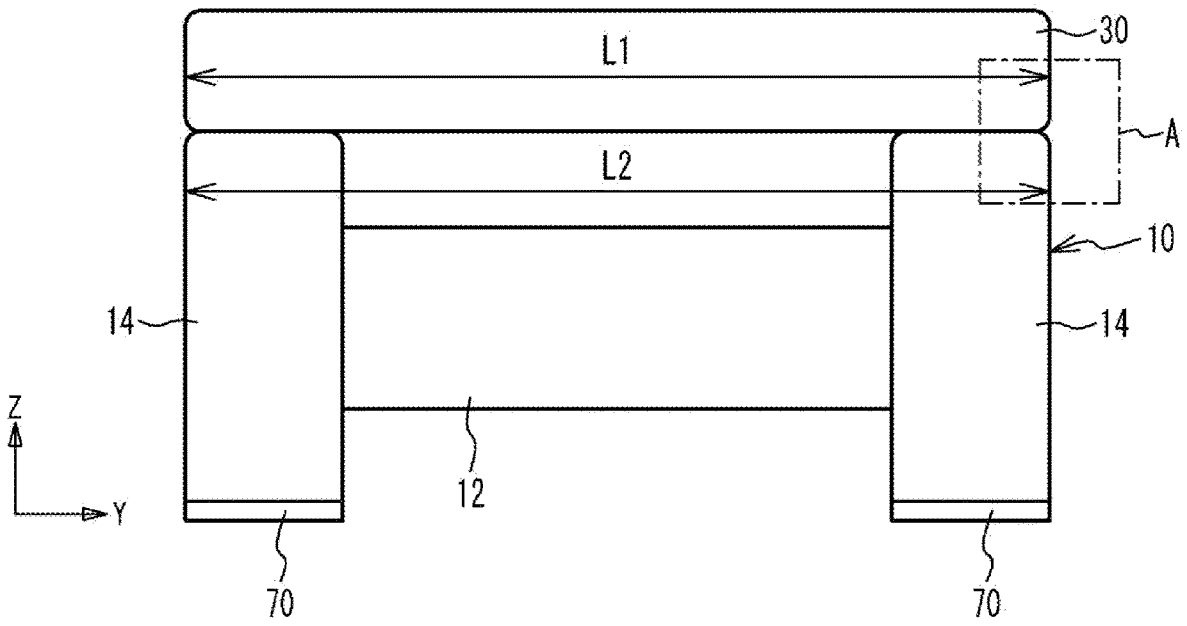
Figure 3B:
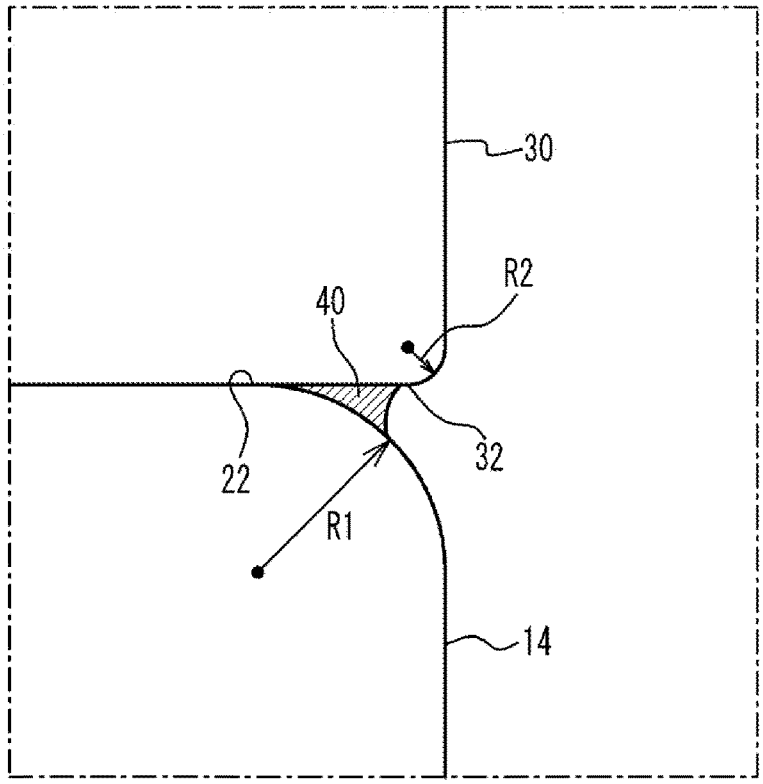
FIG. 3B is an enlarged view of Region A in FIG. 3A.

FIG. 3A is a drawing for explaining the external dimensions of the coil component pertaining to Example 1, while FIG. 3B is an enlarged view of Region A in FIG. 3A. As shown in FIG. 3A, the length L1 of the planar core 30, and the length L2 of the drum core 10, represent roughly the same length in the Y-axis direction. It should be noted that "roughly the same length" does not exclude differences in length to the extent caused by manufacturing error or the like.

As shown in FIG. 3B, the corner parts of the top face 22 of the flange part 14 and bottom face 32 of the planar core 30 are chamfered into a rounded shape. R1 representing the radius of curvature R of the rounded shape provided at the corner parts of the top face 22 of the flange part 14, is greater than R2 representing the radius of curvature R of the rounded shape provided at the corner parts of the bottom face 32 of the planar core 30. It should be noted that "radius of curvature R" indicates the radius dimension of the curved surface forming the rounded shape.

Next, the method for manufacturing the coil component 100 pertaining to Example 1 is explained. Here, the explanation uses an example where a Ni—Zn ferrite material with a magnetic permeability of approx. 400 to 1000 is used as the magnetic material for the drum core 10 and planar core 30. First, a binder is mixed into the Ni—Zn ferrite material, after which the mixture is compression-molded using forming dies to form a compact (e.g., a molded body) for drum core 10 and a compact for planar core 30. Then, the compacts are sintered at a prescribed temperature to form a drum core 10 and a planar core 30.

When forming the compact, varying the fill ratio of the ferrite material (magnetic material) between the flange part 14 of the drum core 10 and the planar core 30 makes it easy to form the flange part 14 and planar core 30 having rounded shapes of different radius of curvature Rs as explained in FIG. 3B. Also, the fill ratio of the ferrite material (magnetic material) for the shaft part 12 of the drum core 10 and the planar core 30 can be set higher than the fill ratio of the ferrite material (magnetic material) for the flange part 14 of the drum core 10, as it allows the mechanical strength of the shaft part 12 and planar core 30 to be increased while maintaining good electrical characteristics, thereby making it possible to reduce the size of the coil component 100.

It should be noted that, if necessary, the compacts may be barreled or otherwise polished so that the surfaces of the compacts have desired surface roughness and/or surface waviness. For this polishing, any generally known polishing method may be used besides barreling. Also, use of an automatic polishing system makes it easy to control the surface roughness and/or surface waviness.

After the drum core 10 and planar core 30 have been formed, an Ag paste is roller-transferred onto a prescribed position on the flange part 14 and then heat-treated, after which an Ni-plating layer and an Sn-plating layer are formed on top, to form an electrode 70. The total thickness of the Ni-plating layer and Sn-plating layer is approx. 10 μm, for example.

Next, a conductive wire 52 is wound around the outer periphery of the shaft part 12 to form a coil 50 having a wound part 54 and lead parts 56. At this time, preferably the surface roughness Ra, as defined in JIS B 0601, of the shaft part 12 is lower than the surface roughness Ra of the flange part 14. This way, the conductive wire 52 can be wound around the outer periphery of the shaft part 12 in a stable manner. Thereafter, an adhesive 40 is provided between the top face 22 of the flange part 14 and the bottom face 32 of the planar core 30, and then the adhesive 40 is cured while being pressed by the drum core 10 and the planar core 30, to bond the top face 22 of the flange part 14 and the bottom face 32 of the planar core 30 with the adhesive 40.

Figure 4:
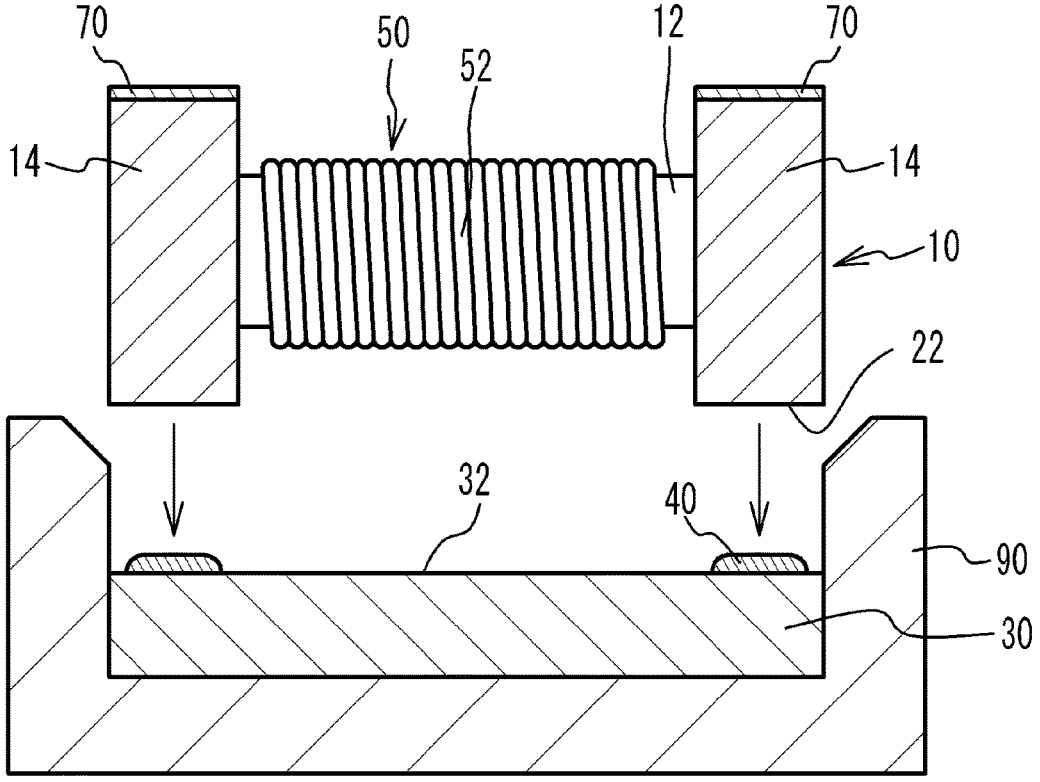
FIG. 4 is a cross-sectional view (1) illustrating the steps to bond the drum core and the planar core.
Figure 5:
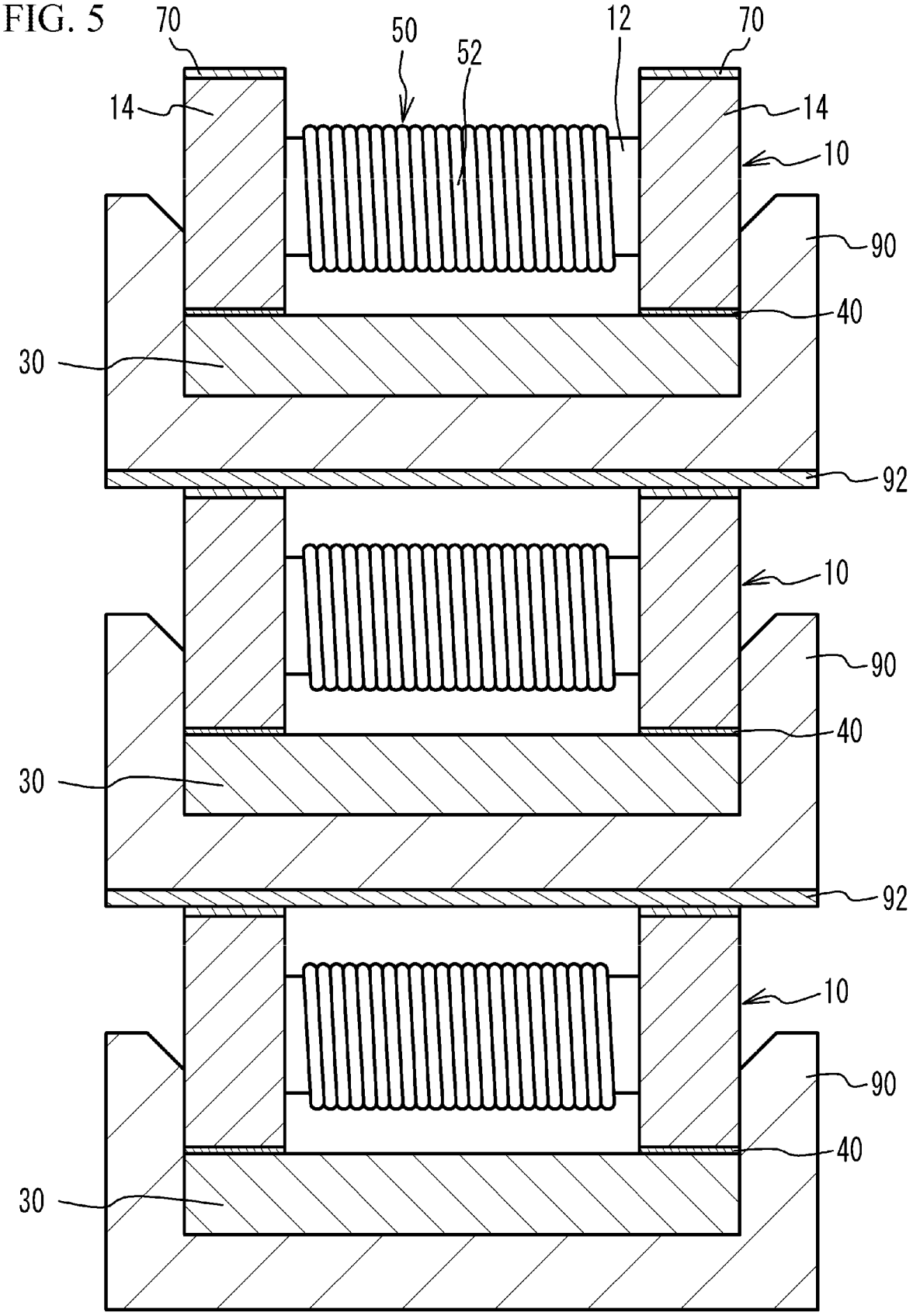
FIG. 5 is a cross-sectional view (2) illustrating the steps to bond the drum core and the planar core.

FIGS. 4 and 5 are cross-sectional views illustrating the steps to bond the drum core and the planar core. As shown in FIG. 4, the planar core 30 is stored in a jig 90 with the bottom face 32 of the planar core 30 facing up, after which a prescribed amount of adhesive 40 is applied at a prescribed position on the bottom face 32 of the planar core 30 using a dispenser, etc. The inner diameter dimension of the jig 90 is roughly the same as the outer diameter dimension of the planar core 30 so that, when the planar core 30 is stored in the jig 90, the planar core 30 is fixed by the jig 90. Thereafter, the top face 22 of the flange part 14 of the drum core 10 is brought in contact with the adhesive 40 applied on the bottom face 32 of the planar core 30.

The application amount and application position of the adhesive 40 are adjusted so that, when the top face 22 of the flange part 14 is bought in contact with the bottom face 32 of the planar core 30, the adhesive 40 does not bleed out from the edges of the top face 22 of the flange part 14, and that the necessary and sufficient amount of adhesive 40 exists between the bottom face 32 of the planar core 30 and the top face 22 of the flange part 14.

As shown in FIG. 5, multiple jigs 90, each storing a drum core 10 and a planar core 30, are stacked and then hot-pressed to thermally cure the adhesive 40 under load. The load may be 0.1 MPa to 1 MPa in equivalent pressure over the contact area, for example. The curing temperature is determined by the glass transition temperature Tg of the adhesive 40. For example, curing is feasible at temperatures higher than the glass transition temperature Tg but no higher than Tg+50° C. Since the adhesive 40 cures under load, the drum core 10 and the planar core 30 bond stably without shifting in posture in the vertical direction. Additionally, fully curing the adhesive 40 inside the jig 90 protects the product against transfer damage compared to when, for example, the product is tentatively cured and then moved to a different system for full curing. This means that, when the drum core 10 and the planar core 30 are bonded, their handling, and the positioning of the adhesive 40, are all completed inside the jig 90, which reduces the number of handling tasks. Also, bonding the drum core 10 and the planar core 30 inside the jig 90 prevents position shift that would otherwise be caused by expansion, contraction, or other behaviors of the adhesive 40 as it cures, even when a small lightweight drum core 10 is used, for example.

Additionally, the process of applying the adhesive 40 on the surface of the bottom face 32 of the planar core 30, placing the drum core 10 on top of the adhesive 40, and applying pressure from the drum core 10 side toward the planar core 30 to cure the adhesive 40, allows the adhesive 40 to wet and spread over the surface of the planar core 30, which means that the thickness of the adhesive 40 can be made uniform, and additionally the thickness can be reduced. Also, allowing the adhesive 40 to be pressed from the flange part 14 side where the surface roughness is higher, makes it easy for the filler 44 in the adhesive 40 to move and enter the concaved parts on the top face 22 of the flange part 14. As a result, the two cores can be brought closer to each other until the top face 22 of the flange part 14 comes in direct contact with the bottom face 32 of the planar core 30. In other words, a desired distance between the two cores can be achieved in a stable manner without being affected by the adhesive 40, and consequently, stably high inductance characteristics can be achieved.

A flexible sheet 92 may be provided on the bottom face of the jig 90. For the sheet 92, a sheet made of synthetic rubber or silicone rubber may be used, for example. Providing the sheet 92 on the bottom face of the jig 90 prevents damage to the drum core 10 even when the hot-pressing load is applied.

Figure 6A:
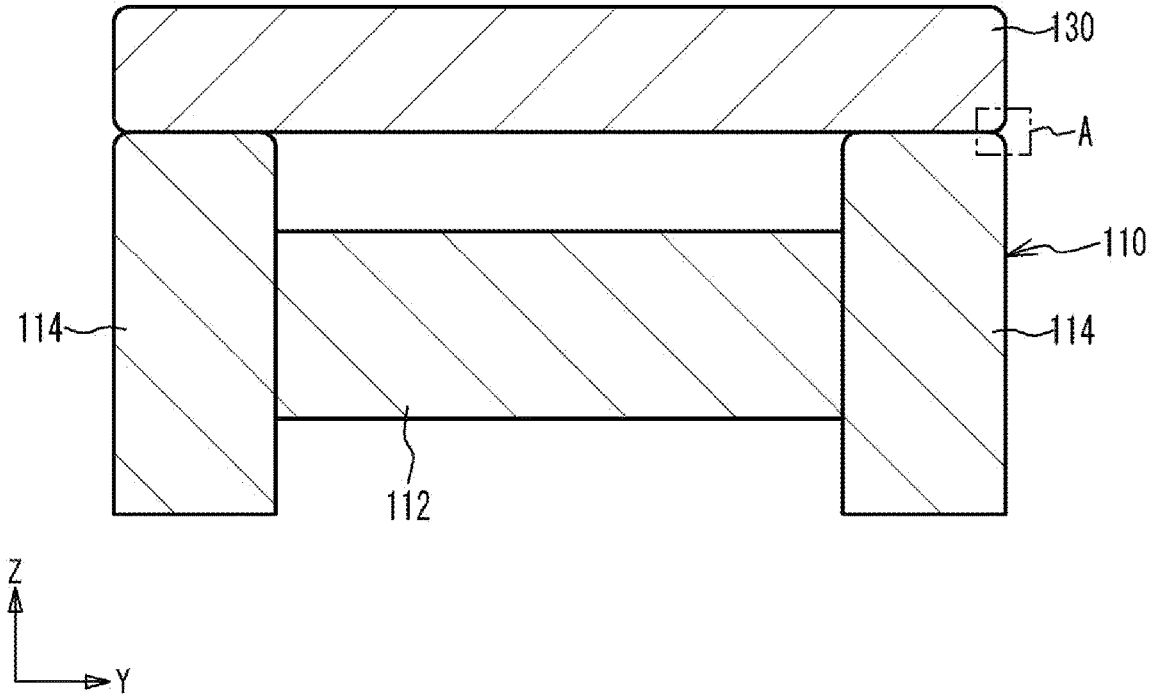
Figure 6B:
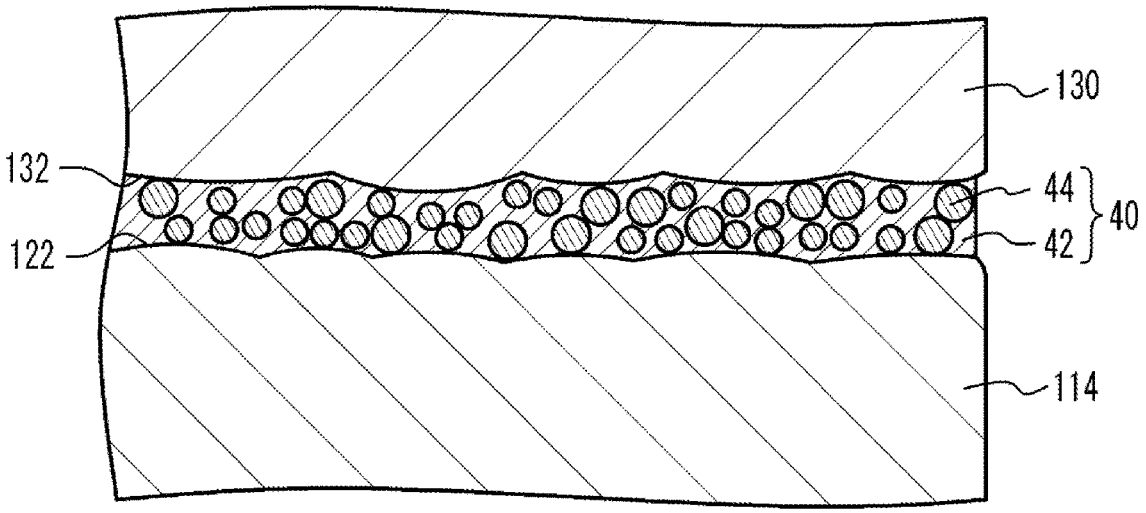
FIG. 6B is an enlarged view of Region A in FIG. 6A.

Now, the coil component pertaining to a comparative example is explained. The coil component in the comparative example is a common mode choke coil just like the one in Example 1. FIG. 6A is a cross-sectional view of the coil component pertaining to the comparative example, while FIG. 6B is an enlarged view of Region A in FIG. 6A. It should be noted that, in FIG. 6A, the coil 50 is not shown for the purpose of illustrative clarity. As shown in FIGS. 6A and 6B, a top face 122 of a flange part 114 of a drum core 110 is bonded with a bottom face 132 of a planar core 130 using an adhesive 40 in the comparative example. The surface roughness of the top face 122 of the flange part 114, and the surface roughness of the bottom face 132 of the planar core 130, are lower than the average grain size of the filler 44. As a result, no proximate parts 46 are formed where the top face 122 of the flange part 114 and the bottom face 132 of the planar core 130 are making contact or facing each other over a very thin resin 42 in between. This means that, depending on the bonding conditions of the adhesive 40, the adhesive 40 which is present between the top face 112 of the flange part 114 and the bottom face 132 of the planar core 130 may become thick or thin. If the adhesive 40 becomes thin, the bonding strength between the flange part 114 and the planar core 130 will drop.

According to Example 1, on the other hand, the surface roughness of the top face 22 of the flange part 14 to be bonded to the planar core 30 via the adhesive 40 is higher than the average grain size of the filler 44, as shown in FIG. 2B. As a result, the filler 44 can enter the concaved parts on the top face 22 of the flange part 14, thereby forming proximate parts 46 where the top face 22 of the flange part 14 and the bottom face 32 of the planar core 30 are making direct contact or facing each other over a very thin resin 42 in between. Because the proximate parts 46 are formed, an adhesive 40 of certain thickness can be formed in the region, other than the proximate parts 46, between the top face 22 of the flange part 14 and the bottom face 32 of the planar core 30. Consequently, good bonding strength can be achieved between the drum core 10 (flange part 14) and the planar core 30.

Also, in the comparative example, the adhesive 40 may become thick and the spacing between the flange part 114 and the planar core 130 may widen depending on the bonding conditions of the adhesive 40. In this case, the magnetic gap will increase and the inductance characteristics will drop. In Example 1, on the other hand, the spacing between the flange part 14 and the planar core 30 is regulated by the proximate parts 46, which means that the spacing between the flange part 14 and the planar core 30 becomes narrower. Accordingly, the magnetic gap can be reduced and good inductance characteristics can be achieved.

As described above, both good bonding strength and good inductance characteristics can be achieved according to Example 1.

Also, according to Example 1, the surface roughness is higher than the average grain size of the filler 44 on both the top face 22 of the flange part 14 and the bottom face 32 of the planar core 30. Because of this, the adhesion of the adhesive 40 present between the flange part 14 and the planar core 30 can be increased, and consequently the bonding strength between the flange part 14 and the planar core 30 can be increased.

Preferably the flange part 14 and the planar core 30 are making direct contact at parts of their top face 22 and bottom face 32 having the adhesive 40 in between. To be specific, preferably the top face 22 of the flange part 14 and the bottom face 32 of the planar core 30 are making direct contact at the proximate parts 46. This way, a spacing of stable size can be achieved between the top face 22 of the flange part 14 and the bottom face 32 of the planar core 30, and an adhesive 40 of certain thickness can be formed easily between the top face 22 of the flange part 14 and the bottom face 32 of the planar core 30. As a result, good bonding strength can be achieved between the flange part 14 and the planar core 30. In addition, stabilization of the spacing between the flange part 14 and the planar core 30 means that stably good characteristics can be achieved when it comes to inductance characteristics as well as other electrical characteristics.

Preferably the surface waviness of the bottom face 32 of the planar core 30 is smaller than the surface waviness of the top face 22 of the flange part 14. Smaller surface waviness of the bottom face 32 of the planar core 30 results in a smaller spacing between the flange part 14 and the planar core 30, and consequently the magnetic gap can be reduced. From the viewpoint of reducing the magnetic gap, the surface waviness Wa of the top face 22 of the flange part 14 is kept to 80 μm or smaller, or 60 μm or smaller. Keeping it in these ranges prevents the inductance characteristics from dropping. Also, surface waviness makes it possible to reduce the number of proximate parts 46 between the flange part 14 and the planar core 30. To be specific, the number of proximate parts 46 decreases, while ensuring provision of directly contacting portions, and this in turn results in a further reduced magnetic gap and stability in magnetic gap.

Figure 7:
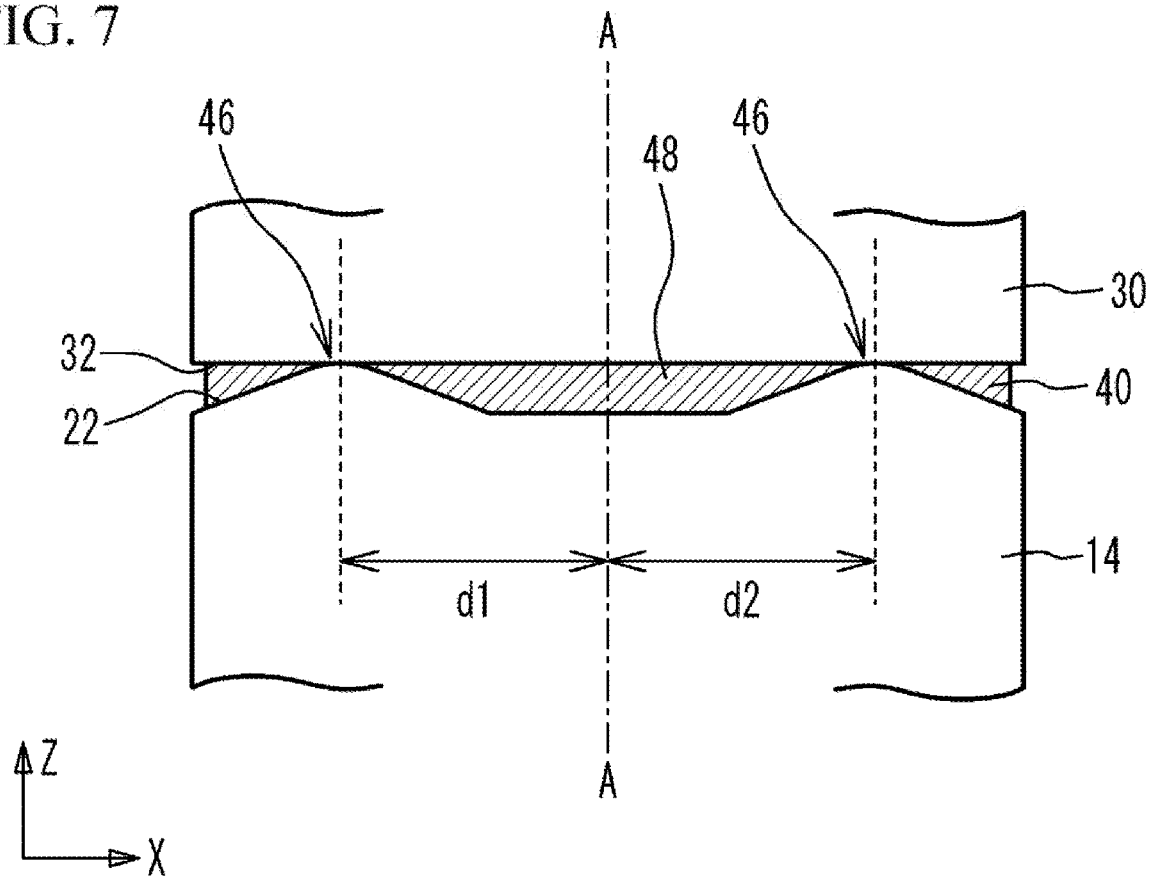
FIG. 7 is a drawing explaining the surface waviness of the flange part.

FIG. 7 is a drawing explaining the surface waviness of the flange part. As shown in FIG. 7, the waviness is such that the center portion of the top face 22 of the flange part 14 is warped in the concaving direction across the X-axis direction (width direction) of the flange part 14. For example, projections are provided over portions d1, d2 that extend outward from the width-direction center line A-A of the flange part 14, so that these projecting portions serve as proximate parts 46. The total sum of the distances d1, d2 is kept to at least one-half the width of the flange part 14. This way, the proximate parts 46 will be provided away from the width-direction center of the flange part 14, allowing for further increase in the stability in bonded state, and increase in the bonding strength.

Also, from the viewpoint of reducing the magnetic gap, the thickness of the adhesive 40 is preferably 25 μm or less, or more preferably 20 μm or less, or yet more preferably 15 μm or less. Because the surface roughness of the top face 22 of the flange part 14 is higher than the average grain size of the filler 44, the result is the formation of proximate parts 46, and the thickness of the adhesive 40 can be kept to 25 μm or less in a stable manner. In addition, a reduced thickness of the adhesive 40 means the adhesive 40 is used by a smaller amount, which allows the amount of adhesive 40 that bleeds out from the prescribed regions to be kept under control.

As shown in FIG. 1, preferably the adhesive 40 provided between the flange part 14 and the planar core 30, is away from the conductive wire 52 forming the coil 50. This prevents the adhesive 40 from affecting the conductive wire 52. For example, stressing of the conductive wire 52 caused by volume shrinkage of the adhesive 40 as it cures, chemical reaction between any component constituting the adhesive 40 and any insulating film component of the conductive wire 52, or change in the stray capacitance in the conductive wire 52 due to the adhesive 40, can be prevented, and the like.

Preferably the fill ratio of the magnetic material for the planar core 30 and the shaft part 12 constituting the drum core 10, is higher than the fill ratio of the magnetic material for the flange part 14 constituting the drum core 10. This way, the mechanical strength of the planar core 30 and the shaft part 12 can be increased while maintaining good electrical characteristics, which allows for size reduction of the coil component 100.

The external dimensions of the coil component 100 in Example 1 are 3.2 mm in length (length in the Y-axis direction), 2.5 mm in width (length in the X-axis direction), and 2.5 mm in height (length in the Z-axis direction), in one example. The external dimensions of the drum core 10 are 2.9 mm in length, 2.5 mm in width, and 2.1 mm in height, in one example. The external dimensions of the shaft part 12 of the drum core 10 are 1.1 mm in width and 0.8 mm in height, in one example, while the thickness (length in the Y-axis direction) of the flange part 14 is 0.3 mm, in one example. The external dimensions of the planar core 30 are 3.2 mm in length, 2.5 mm in width, and 0.4 mm in height, in one example. It should be noted that the length (length in the Y-axis direction) of the planar core 30 can be adjusted to 3.2 mm or less, or it may also be 2.5 mm, or 1.6 mm.

Example 2

Figure 8A:
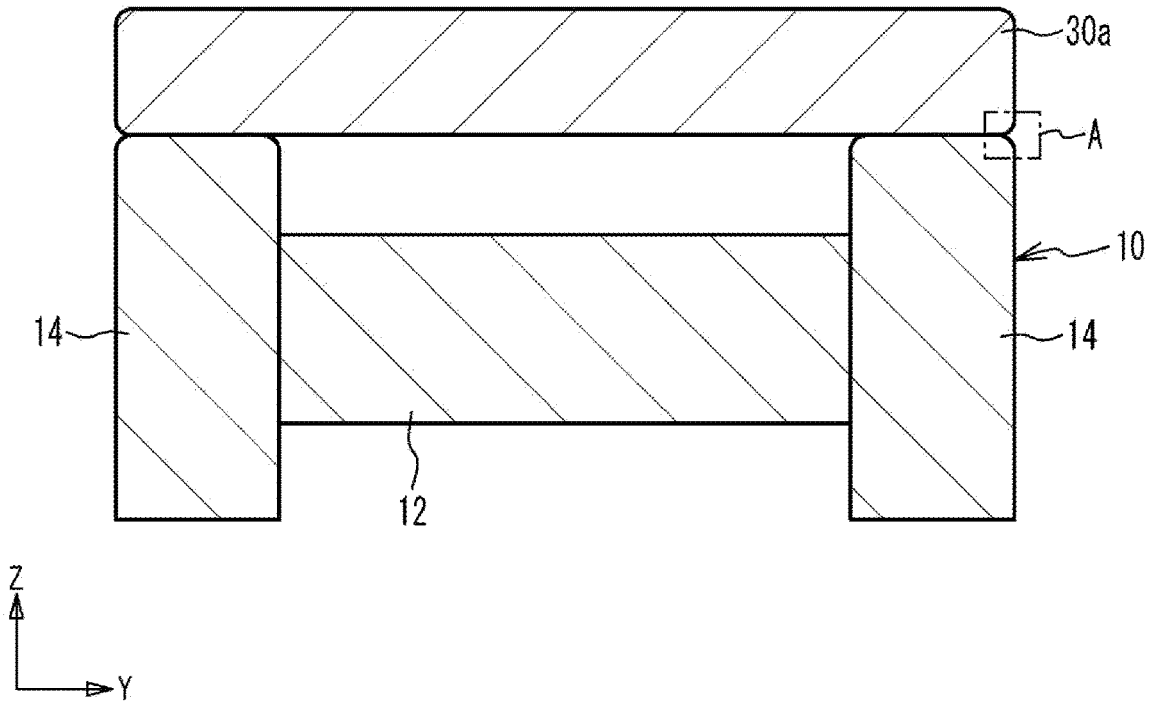
Figure 8B:
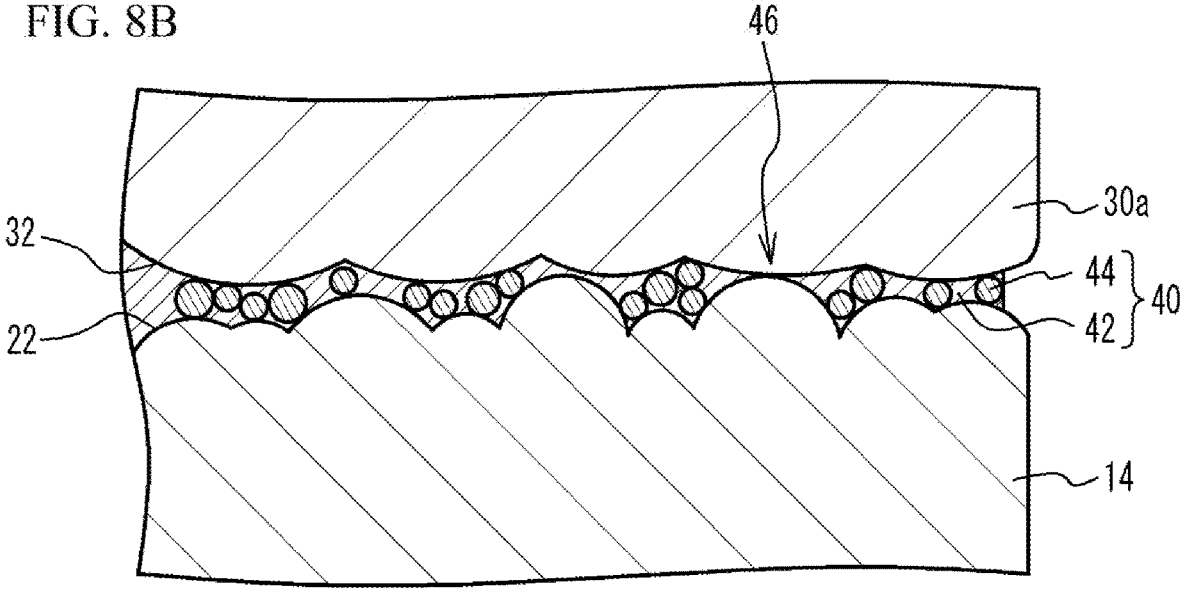
FIG. 8B is an enlarged view of Region A in FIG. 8A.

FIG. 8A is a cross-sectional view of the coil component pertaining to Example 2, while FIG. 8B is an enlarged view of Region A in FIG. 8A. It should be noted that, in FIG. 8A, the coil 50 is not shown for the purpose of illustrative clarity. As shown in FIGS. 8A and 8B, in Example 2, the surface roughness of the top face 22 of the flange part 14 is higher than the average grain size of the filler 44, but the surface roughness of the bottom face 32 of a planar core 30*a* is lower than the surface roughness of the top face 22 of the flange part 14 and lower than the average grain size of the filler 44. For example, the surface roughness Rz of the top face 22 of the flange part 14 is higher than the average grain size of the filler 44, while the surface roughness Rz of the bottom face 32 of the planar core 30*a* is lower than the surface roughness Rz of the top face 22 of the flange part 14 and lower than the average grain size of the filler 44. For example, by making the grain size of the magnetic material used for the drum core 10 larger than the grain size of the magnetic material used for the planar core 30*a*, or by making the fill ratio of the magnetic material at the drum core 10 lower than the fill ratio of the magnetic material at the planar core 30*a*, the surface roughness of the top face 22 of the flange part 14 can be increased, or the surface roughness of the bottom face 32 of the planar core 30*a* can be decreased. Also, the drum core 10 can be barreled or otherwise machined using a large medium, for example, to increase the surface roughness of the top face 22 of the flange part 14. The remaining constitutions are the same as those in Example 1 and therefore not illustrated or explained.

The surface roughness Rz of the top face 22 of the flange part 14 is 10 μm or higher, for example, but it may be 20 μm or higher. The surface roughness Rz of the bottom face 32 of the planar core 30*a* is 1 μm or higher, for example, but it may be 10 μm or higher. The surface roughness Rz of the top face 22 of the flange part 14, and the surface roughness Rz of the bottom face 32 of the planar core 30*a*, are 30 μm or lower, for example. In one example, where the drum core 10 and planar core 30*a* are formed by a Ni—Zn ferrite material, the surface roughness Rz of the top face 22 of the flange part 14 is approx. 15 μm, while the surface roughness Rz of the bottom face 32 of the planar core 30*a* is approx. 1 μm. Thus, in the case of the drum core 10 and planar core 30*a*, the surface roughness Rz of the bottom face 32 of the planar core 30 may be adjusted lower than the surface roughness Rz of the top face 22 of the flange part 14.

According to Example 2, the surface roughness of the bottom face 32 of the planar core 30*a* is lower than the surface roughness of the top face 22 of the flange part 14 and lower than the average grain size of the filler 44. This way, the area created between the flange part 14 and the planar core 30*a* can be reduced, and the magnetic gap can be reduced further.

It should be noted that the surface roughness relationship of the drum core 10 and the planar core 30*a* may be reversed. In other words, the surface roughness of the bottom face of the planar core may be higher than the average grain size of the filler 44, while the surface roughness of the top face of the flange part constituting the drum core may be lower than the surface roughness of the bottom face of the planar core and lower than the average grain size of the filler 44. In this case, the planar core corresponds to the first substrate body whose face bonded to the other substrate body (i.e., the second substrate body) is required to have a surface roughness higher than an average particle size of the filler particles, while the drum core corresponds to the second substrate body.

Example 3

Figure 9A:
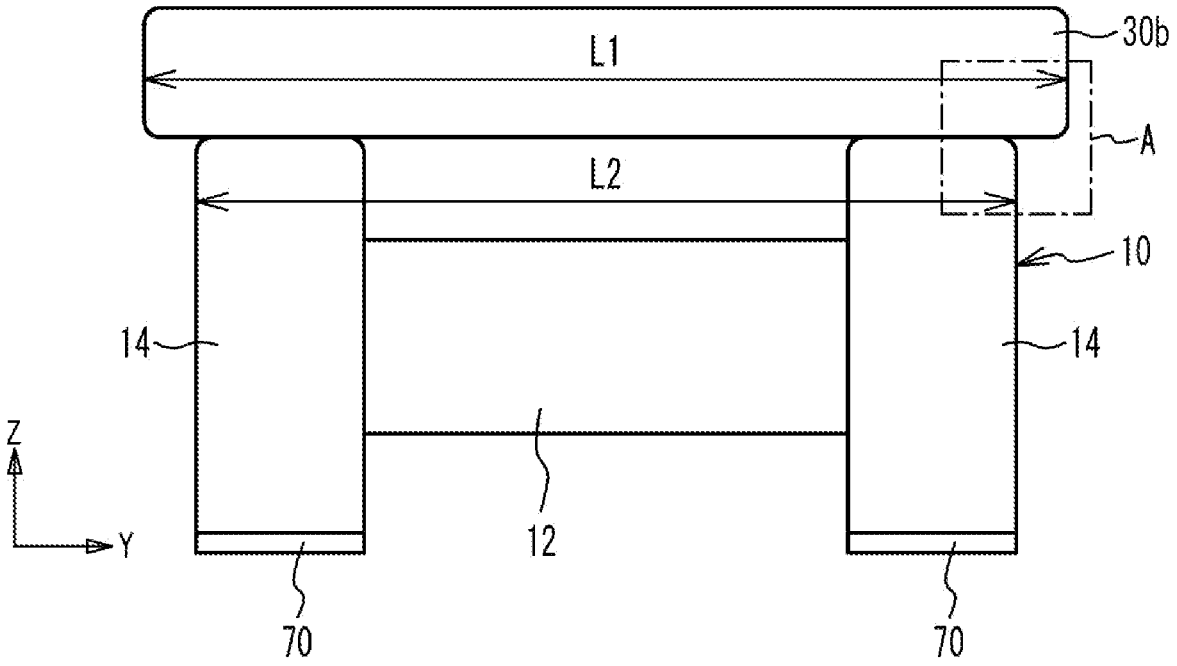
Figure 9B:
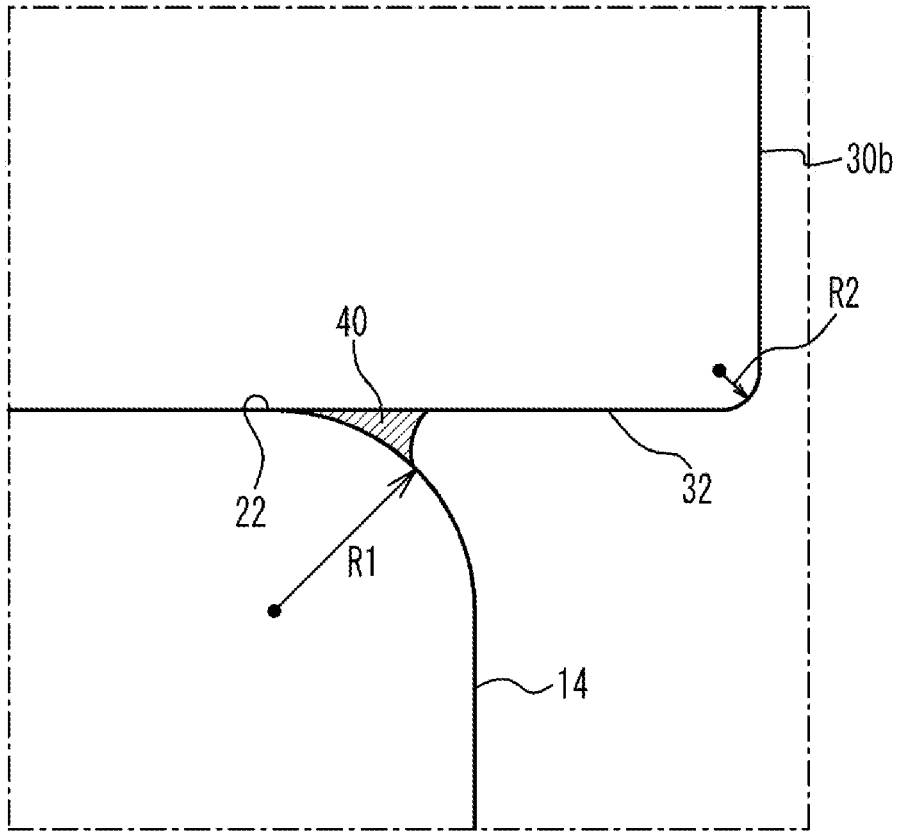
FIG. 9B is an enlarged view of Region A in FIG. 9A.

The coil component in Example 3 is the same as the coil component 100 in Example 1, except that the length of a planar core 30*b* is different from that of the planar core 30 in Example 1, so no part of it is illustrated or explained other than the length of the planar core 30*b*. FIG. 9A is a drawing for explaining the external dimensions of the coil component pertaining to Example 3, while FIG. 9B is an enlarged view of Region A in FIG. 9A. As shown in FIG. 9A, the length L1 of the planar core 30*b* is longer than the length L2 of the drum core 10. For example, the length L1 of the planar core 30*b* is approx. 0.1 mm to 0.2 mm longer than the length L2 of the drum core 10. As shown in FIG. 9B, the corner parts of the top face 22 of the flange part 14 and bottom face 32 of the planar core 30*b* are chamfered into a rounded shape, just like in Example 1. The length difference (L1−L2) between the planar core 30*b* and the drum core 10 is greater than the radius of curvature R R1 of the rounded shape provided at each corner part of the top face 22 of the flange part 14.

According to Example 3, the length L1 of the planar core 30*b* in the Y-axis direction (direction of the coil axis) is longer than the length L2 of the drum core 10 in the Y-axis direction (direction of the coil axis). As a result, any position shift between the drum core 10 and the planar core 30*b* due to bonding can be absorbed, and this prevents the bonding area from changing, to achieve stability in electrical characteristics. It should be noted that, while FIG. 9A explained the lengths of the planar core 30*b* and drum core 10 in the Y-axis direction, preferably the relationship is similar between the lengths of the planar core 30*b* and drum core 10 in the X-axis direction. To be specific, preferably the length of the planar core 30*b* in the X-axis direction is longer than the length of the drum core 10 in the X-axis direction.

Also, a rounded shape is formed at each corner part of the top face 22 of the flange part 14. And, the difference between the length L1 of the planar core 30*b* and the length L2 of the drum core 10 in the Y-axis direction (direction of the coil axis), or (L1−L2), is greater than the radius of curvature R R1 of the rounded shape at each corner part of the top face 22 of the flange part 14. As a result, in the portions corresponding to the rounded shapes at the corner parts of the top face 22 of the flange part 14, the adhesive 40 tries to remain inside the spaces created by the rounded shapes provided at the corner parts of the top face 22 of the flange part 14, and consequently wetting and spreading of the adhesive 40 can be controlled. Also, bleeding of the adhesive 40 in the length direction can be prevented because the length of the planar core 30*b* is greater.

Example 4

Examples 1 to 3 illustrated a common mode choke coil having a drum core 10 and a planar core 30 as an example of coil component; however, this is not the only example and there may be other applications such as inductors, filters, transformers, etc. In Example 4, a coil component which is an inductor element having an E-core and an I-core, is explained.

Figure 10A:
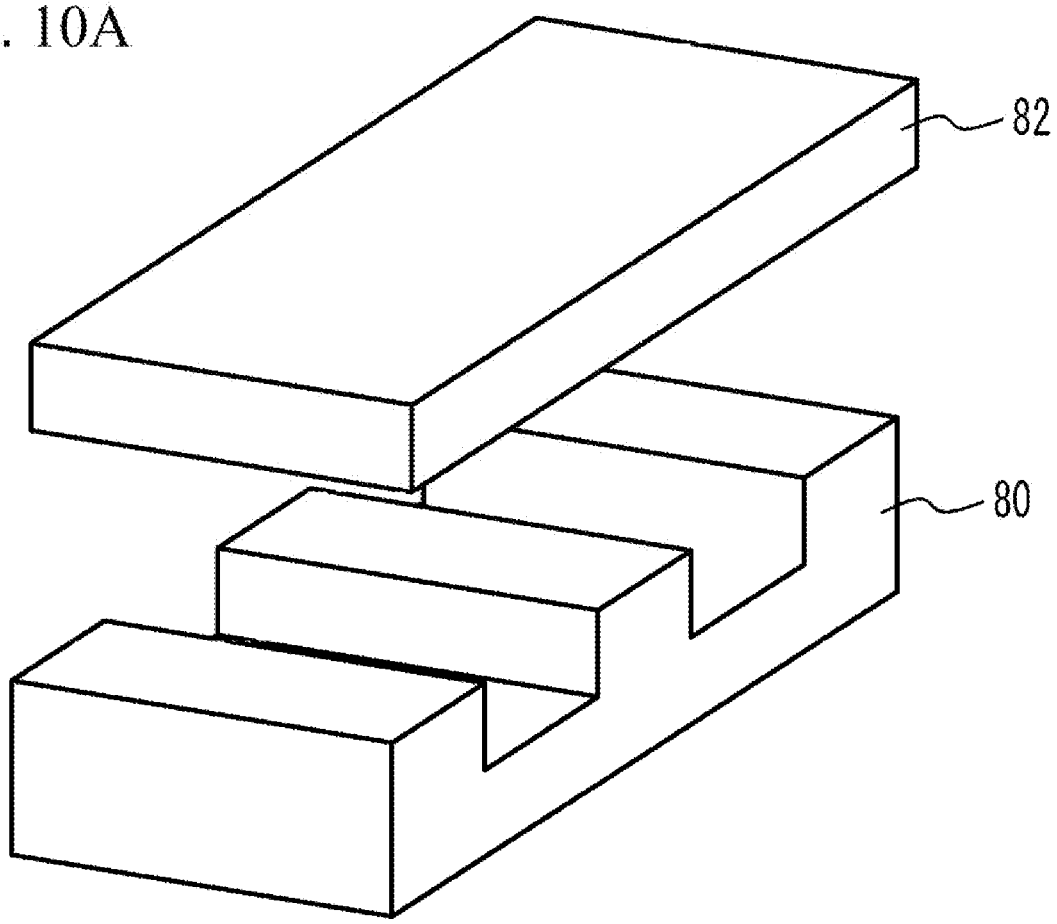
Figure 10B:
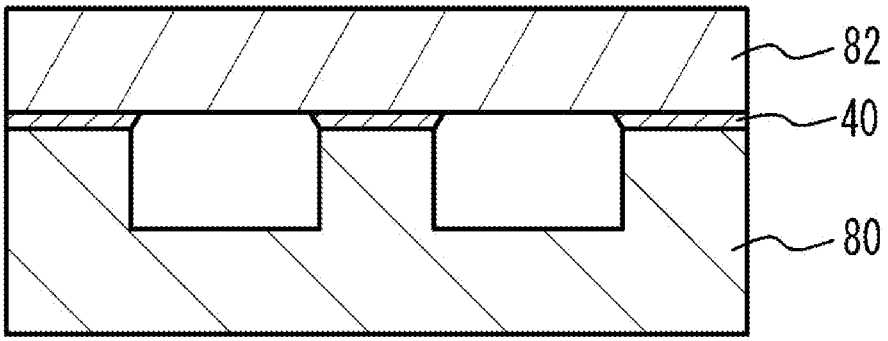
FIG. 10B is a cross-sectional view of the E-core and the I-core as bonded by an adhesive.

FIG. 10A is a perspective view showing an E-core and an I-core, while FIG. 10B is a cross-sectional view of the E-core and the I-core as bonded by an adhesive. As shown in FIG. 10B, an E-core 80 and an I-core 82 shown in FIG. 10A are bonded by an adhesive 40. The E-core 80 and the I-core 82 may be formed by the same magnetic material, or they may be each formed by a different magnetic material. The external dimensions of the bonded E-core 80 and I-core 82 are 5.0 mm in length, 4.0 mm in width, and 2.5 mm in height, in one example. It should be noted that the I-core 82 corresponds to the first substrate body whose face bonded to the other substrate body (i.e., the second substrate body) is required to have a surface roughness higher than an average particle size of the filler particles, while the E-core 80 corresponds to the second substrate body.

The surface roughness of the face of the I-core 82 to be bonded to the E-core 80 via the adhesive 40 has a relationship similar to that of the drum core 10 in Example 1, meaning that it is higher than the average grain size of the filler 44 contained in the adhesive 40. The surface roughness of the face of the E-core 80 to be bonded to the I-core 82 via the adhesive 40 may be lower than the surface roughness of the face of the I-core 82 to be bonded to the E-core 80 via the adhesive 40. Also, the surface roughness of the face of the E-core 80 to be bonded to the I-core 82 via the adhesive 40 may be higher than the average grain size of the filler 44. For example, by making the grain size of the magnetic material used for the I-core 82 larger than the grain size of the magnetic material used for the E-core 80, or by making the fill ratio of the magnetic material at the I-core 82 lower than the fill ratio of the magnetic material at the E-core 80, the surface roughness of the I-core 82 can be increased, or the surface roughness of the E-core 80 can be decreased. Also, the I-core 82 can be barreled or otherwise machined using a large medium, for example, to increase the surface roughness of the I-core 82.

The surface roughness Rz of the I-core 82 is 20 μm or higher, for example, while the surface roughness Rz of the E-core 80 is 10 μm or higher, for example. The surface roughness Rz of the E-core 80 and I-core 82 is 50 μm or lower, for example. Keeping the surface roughness Rz to 50 μm or lower makes it easy for the adhesive 40 to wet and spread over the surface of the E-core 80 and I-core 82. As a result, the thickness of the adhesive 40 can be made uniform, and additionally the thickness can be reduced. For example, the thickness of the adhesive 40 can be kept to 50 μm or less where it is thickly applied. Also, from the viewpoint of ensuring mechanical strength of the E-core 80 and I-core 82, the surface roughness Rz may be kept to 30 μm or lower. In one example where the E-core 80 and I-core 82 are formed by a Fe—Si—Cr alloy magnetic material, the surface roughness Rz of the I-core 82 is approx. 20 μm, while the surface roughness Rz of the E-core 80 is approx. 10 μm. It should be noted that the surface roughness is adjusted by the manufacturing conditions of the E-core 80 and I-core 82, for example, and the surface roughness of the E-core 80 and that of the I-core 82 are considered the same if their difference is within 50%, or different if the difference exceeds 50%.

For the magnetic material of the E-core 80 and I-core 82, an alloy magnetic material containing Fe and Si may be used, for example. Preferably the magnetic permeability GO of the magnetic material is 30 to 60. Regarding the method for manufacturing the E-core 80 and I-core 82, first a binder is mixed into Fe—Si—Cr alloy magnetic grains, and then the mixture is compression-molded using forming dies to form a compact that will become an E-core 80 and a compact that will become an I-core 82. At this time, the fill ratio of the magnetic material may be varied between the compacts. For example, preferably the fill ratio of the magnetic material for the compact of E-core 80 is higher than the fill ratio of the magnetic material for the compact of I-core 82. This increases the mechanical strength of the E-core 80 that damages easily, thereby making it possible to reduce the size of the inductor element. Thereafter, the compacts are heat-treated to cure the resin, or the surfaces of the alloy magnetic grains are oxidized at a prescribed temperature to cause the alloy magnetic grains to bond together at their insulating films, thereby forming an E-core 80 and an I-core 82.

After the E-core 80 and I-core 82 have been formed, an electrode is formed on at least one of the E-core 80 and I-core 82. Next, a conductive wire is used to form a coil in the space inside the E-core 80. Thereafter, the E-core 80 and the I-core 82 are bonded using an adhesive 40. The bonded portions of the E-core 80 and the I-core 82 have shapes similar to those shown in FIG. 2 pertaining to Example 1.

The foregoing shows that, even when an E-core 80 and an I-core 82 are bonded with an adhesive 40, good bonding strength can be achieved between the E-core 80 and the I-core 82, just like in Example 1, because the surface roughness of the face of the I-core 82 to be bonded to the E-core 80 via the adhesive 40 is higher than the average grain size of the filler 44. Also, the spacing between the E-core 80 and the I-core 82 can be reduced, just like in Example 1, which means that good inductance characteristics can be achieved.

It should be noted that the surface roughness relationship of the E-core 80 and the I-core 82 may be reversed. In other words, the surface roughness of the face of the E-core 80 to come in contact with the adhesive 40 may be higher than the average grain size of the filler 44, while the surface roughness of the face of the I-core 82 to come in contact with the adhesive 40 may be lower than the surface roughness of the face of the E-core 80 to come in contact with the adhesive 40, and it may also be lower than the average grain size of the filler 44, for example. In this case, the E-core 80 corresponds to the first substrate body whose face bonded to the other substrate body (i.e., the second substrate body) is required to have a surface roughness higher than an average particle size of the filler particles, while the I-core 82 corresponds to the second substrate body. Furthermore, each of the first and second substrate bodies may independently be constituted by more than one discrete parts—for example, two or more E-cores 80 and I-cores 82 may be used—and the number of substrate bodies is not limited in any way. The same also applies to Example 1 where two or more planar cores 30 and drum cores 10 may be used.

Example 5

Figure 11:
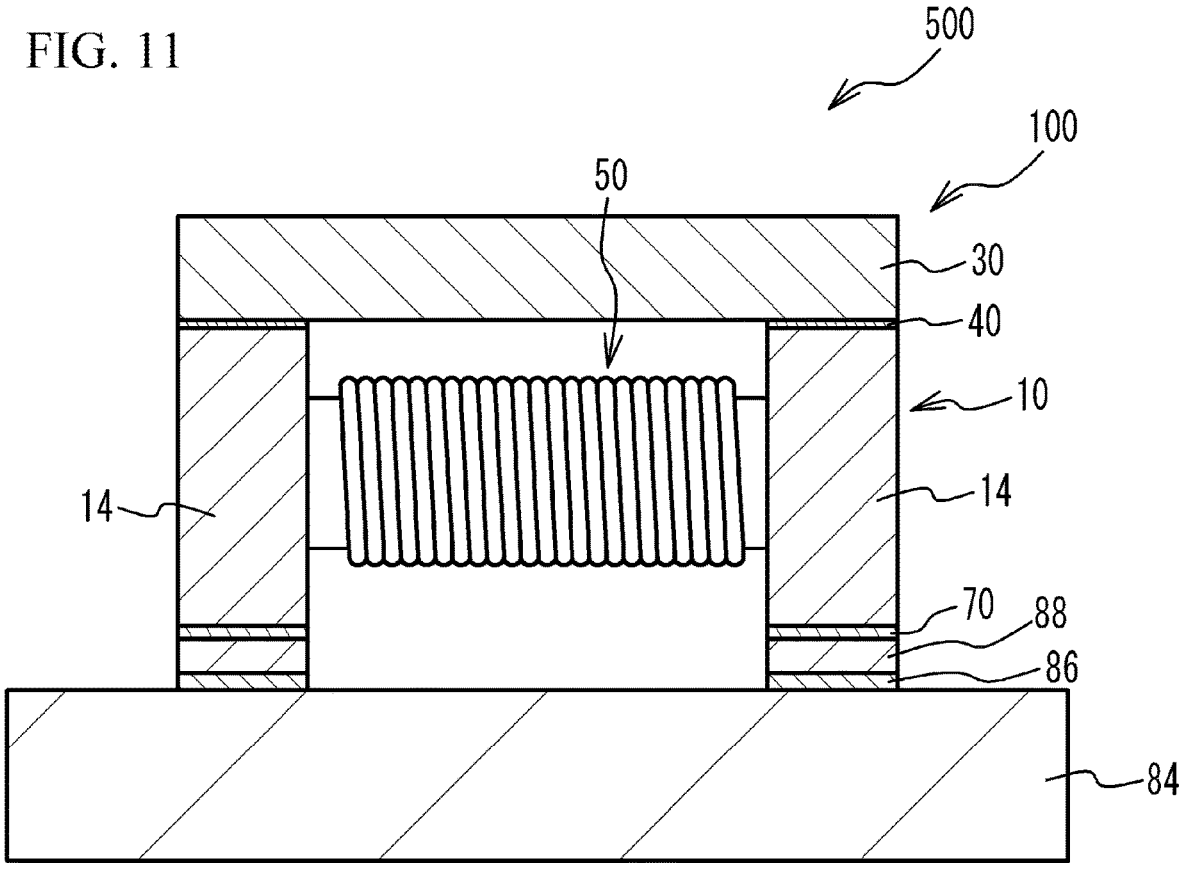
FIG. 11 is a cross-sectional view of the electronic device pertaining to Example 5.

FIG. 11 is a cross-sectional view of the electronic device pertaining to Example 5. As shown in FIG. 11, the electronic device 500 comprises a circuit board 84 and the coil component 100 in Example 1 that has been mounted on the circuit board 84. The coil component 100 is mounted on the circuit board 84 with its electrodes 70 joined to electrodes 86 on the circuit board 84 by a solder 88.

According to the electronic device 500 in Example 5, the coil component 100 in Example 1 is mounted on a circuit board 84. This way, an electronic device 500 comprising a coil component 100 that offers high impact resistance as a result of improved bonding strength between its drum core 10 and planar core 30, can be obtained. It should be noted that, while Example 5 illustrated an example where the coil component 100 in Example 1 is mounted on a circuit board 84, any of the coil components in Examples 2 to 4 may be mounted instead.

The foregoing described the examples of the present invention in detail; however, the present invention is not limited to these specific examples and various modifications and changes may be added so long as doing so does not deviate from the key points of the present invention as described in "What Is Claimed Is."

I claim:

1. A coil component, comprising:

a first substrate body and a second substrate body, both formed in a manner containing a magnetic material;

an adhesive containing an organic material and filler particles, which bonds the first substrate body and the second substrate body, wherein the filler particles are inorganic grains other than the magnetic material;

a coil formed by a conductor having an insulating film, provided in either the first or second substrate body; and electrodes connected electrically to the coil;

wherein a representative surface roughness, as maximum height roughness Rz, of a face of the first substrate body bonded to the second substrate body via the adhesive is higher than an average or representative particle size of the filler particles, and wherein the first substrate body and the second substrate body are randomly making direct contact without intervening adhesive at parts of their faces having the adhesive in between.

2. The coil component according to claim 1, wherein a surface roughness of a face of the second substrate body bonded to the first substrate body via the adhesive is lower than the surface roughness of the face of the first substrate body bonded to the second substrate body via the adhesive.

3. The coil component according to claim 1, wherein:

the first substrate body is a drum core having a shaft part around which the conductive wire is wound, and flange parts provided at both ends of the shaft part;

the second substrate body is a plate-shaped planar core bonded to the two flange parts provided at both ends of the shaft part; and the adhesive bonds the flange parts and the planar core.

4. The coil component according to claim 3, wherein a length of the planar core in a direction of a coil axis of the coil is longer than a length of the drum core in the direction of the coil axis.

5. The coil component according to claim 4, wherein:

a rounded shape is formed at each ridge part of the flange part on a face bonded to the planar core via the adhesive; and a difference between the length of the planar core and the length of the drum core in the direction of the coil axis is greater than a radius of curvature R of the rounded shape of the flange part.

6. The coil component according to claim 3, wherein a fill ratio of the magnetic material for the planar core and the shaft part is higher than a fill ratio of the magnetic material for the flange part.

7. The coil component according to claim 3, wherein the length of the planar core in the direction of the coil axis of the coil is 3.2 mm or less.

8. An electronic device, comprising:

the coil component according to claim 1; and a circuit board on which the coil component has been mounted.

9. The coil component according to claim 1, wherein the organic material contained in the adhesive is a thermosetting resin.

* * * * *